US005212357A

United States Patent [19]

Reneau

[11] Patent Number: 5,212,357

[45] Date of Patent: May 18, 1993

[54] EXTENDED MINIMUM DWELL SHOCK SENSOR

[75] Inventor: Daniel R. Reneau, Madison, Wis.

[73] Assignee: Hamlin, Inc., Lake Mills, Wis.

[21] Appl. No.: 745,205

[22] Filed: Aug. 14, 1991

[51] Int. Cl.[5] ..... H01H 35/14

[52] U.S. Cl. ..... 200/61.45 M; 200/61.53; 335/205

[58] Field of Search ..... 200/61.45 R, 61.45 M, 200/61.53; 335/205, 206

[56] References Cited

U.S. PATENT DOCUMENTS

| | | | |
|---|---|---|---|
| 3,412,391 | 11/1968 | Ward | 340/690 |
| 3,795,780 | 3/1974 | Lawrie | 200/61.45 R |
| 3,967,079 | 6/1976 | Sasaya et al. | 200/61.45 R |
| 4,074,095 | 2/1978 | Romanowski | 200/81.9 M |
| 4,117,430 | 9/1978 | Sims, Jr. | 335/205 |
| 4,518,835 | 5/1985 | Grossar | 200/61.45 M |
| 4,638,276 | 1/1987 | Hauk | 335/151 |
| 4,705,922 | 11/1987 | Seeger et al. | 200/61.45 M |
| 4,877,927 | 10/1989 | Reneau | 200/61.45 M |
| 4,980,526 | 12/1990 | Reneau | 200/61.45 M |

OTHER PUBLICATIONS

Reed Switch Application Manual, Copyright 1987, Hamlin, Inc. Lake Mills, Wis.

*Primary Examiner*—J. R. Scott
*Attorney, Agent, or Firm*—Lathrop & Clark

[57] ABSTRACT

A shock sensor achieving the advantages of extended minimum dwell and extended total dwell employs a reed switch in a housing mounted coaxial to the reed switch. The shock sensor employs a magnet of cylindrical shape, which is coaxial with the reed switch and slidably mounted to activate the reed switch. The shape of the activation magnet, which also serves as an acceleration detecting mass, is that of a cylindrical shell which extends along the axis of the reed switch. The shell has a ring portion extending radially inward and of short axial extent on the end of the magnet which lags in activation. A spring extends between an abutment and the magnet within the shell. When the shock sensor is subjected to an acceleration, the magnet is moved by the acceleration force from a non-activating position. Further extending the activation dwell time of the sensor and, in addition, providing an extended minimum dwell time, is the shape of the magnetic field created by the ring at the first abutting end of the magnet.

16 Claims, 5 Drawing Sheets

EXTENDED MINIMUM DWELL SHOCK SENSOR

FIELD OF THE INVENTION

This invention relates to reed switches in general, and to reed switches employed in shock sensors in particular.

BACKGROUND OF THE INVENTION

Shock sensors employing reed switches are used in motor vehicles to detect vehicle collisions. When such a collision occurs, the shock sensor triggers an electronic circuit for the actuation of one or more safety devices. Devices which may be actuated include air bags, safety belt tensioners, fuel system shut offs, and radio signals. Shock sensors typically employ a reed switch and an acceleration sensing magnet. The magnet is typically biased by a spring against an abutment spaced from the reed switch such that the unaccelerated reed switch is not activated. When the vehicle and the reed switch which is rigidly attached to the vehicle are subject to a crash-induced acceleration, the magnet, acting as an acceleration-sensing mass, moves relative to the reed switch to a position which activates the reed switch.

The duration with which the reed switch in a shock sensor remains activated is important. The complexity of the circuitry required to detect activation and the reliability of the differentiation between switch activation and spurious noise is dependent on the time the switch remains closed --known as the switch dwell time. Longer dwell time permits simpler circuitry and greater detection reliability.

Known shock sensors employ mechanical delay mechanisms which retard return of the activation magnet to the unactivated position and thereby increase the duration of activation. Though quite effective, shock sensors employing mechanical delays result in shock sensors of somewhat greater mechanical complexity and size.

Other known shock sensors increase the time of switch activation by increasing the sensitivity of the contacts of the reed switch, or increasing the length of the activation magnet, to effect an increase in the size of the switch activating regions. However, increasing the length of the magnet and the distance which the magnet may travel while activating the reed switch increases the package size of the shock sensor and, further, does not address the problem of minimum dwell associated with a minimum crash situation.

Because placement of the shock sensor within the automobile may be critical to its reliable and effective operation, packaging size of the overall shock sensor is important, because a smaller sensor may be more readily mounted in a suitable location.

Switches having an extended minimum dwell time are advantageous in many situations where it is important to avoid ambiguity caused by extremely short minimum dwell or closure times.

What is needed is a shock sensor with extended dwell and extended minimum dwell, which is available in a physical package of small dimensions.

SUMMARY OF THE INVENTION

A shock sensor achieving advantages of extended minimum dwell and extended total dwell employs a reed switch in a housing mounted coaxial to the reed switch. The reed switch has three activation regions, one on either end and one in the middle. The shock sensor has an activation magnet slidably mounted on the housing and having a first portion adapted to engage against the first abutment and a second portion adapted to engage against the second abutment. The first portion has a greater magnetic flux than the second portion. In one embodiment, the shock sensor employs a magnet of cylindrical shape, which is coaxial with the reed switch and slidably mounted between a first and a second abutment. The first abutment is positioned such that when the magnet abuts the first abutment, it is in a non-activation region between the central activation region and an end activation region. The shape of the activation magnet, which also serves as an acceleration detecting mass, is that of a cylindrical shell which extends along the axis of the reed switch. The shell has a portion extending radially inward and of short axial extent on the end of the magnet which abuts the first abutment. The magnet has a cylindrical shell with a thickened ring at the first abutting end. The ring has an outside face which forms the first abutting end of the magnet, and an inside face which extends radially from the housing to the inside of the cylindrical shell portion of the magnet.

A helically wound spring is disposed between the second abutment and the interior radially extending surface of the ring, such that when an accelerating force causes the magnet to move until the second end of the magnet rests against the second abutment, the biasing spring is wholly contained between the cylindrical portion of the magnet and the housing. The second abutment is positioned relative to the central activation region such that the reed switch remains activated when acceleration forces the magnet against the second abutment.

When the shock sensor is subjected to an acceleration such as caused by a car crash the magnet is moved by the acceleration force from a non-activating position as biased against the first abutment, to an activating position and continues to move in the activation region until it comes to rest against the second abutment. Because the biasing spring is contained between the magnet and the housing and does not hold the magnet away from the second abutment, the activating magnet will have a longer travel path and so a longer dwell time than known shock sensors, where the biasing spring is compressed between the second abutment and the second end of the activation magnet.

Further extending the activation dwell time of the sensor and, in addition, providing an extended minimum dwell time, is the shape of the magnetic field created by the ring at the first abutting end of the magnet. As the activation magnet travels between the first abutment and the second abutment and returns to the first abutment, the point at which the reed switch opens is closer to the first abutment than the point at which the reed switch closes as the activation magnet moves away from the first abutment. The distance between the activation point where the reed switch will be activated and the deactivation point where the reed switch will open, is increased by the use of a magnetic field of the shape created by the ring portion of the activation magnet.

The activation magnet has a field shape which results in an increased minimum dwell time. A crash just sufficient to move the magnet against the biasing spring to the activation point, will result in a finite dwell time as the magnet moves between the activation and the deactivation point. Spacing between the activation and deactivation points is increased by the use of a magnet such as discussed above which creates a field of proper shape.

It is an object of the present invention to provide a shock sensor with extended minimum dwell time.

It is also an object of the present invention to provide a shock sensor with extended dwell time.

It is yet another object of the present invention to provide a shock sensor exhibiting improved performance in a smaller physical package.

Further objects, features, and advantages of the invention will be apparent from the following detailed description when taken in conjunction with the accompanying drawings.

DESCRIPTION OF THE PREFERRED EMBODIMENT

Figure 1:
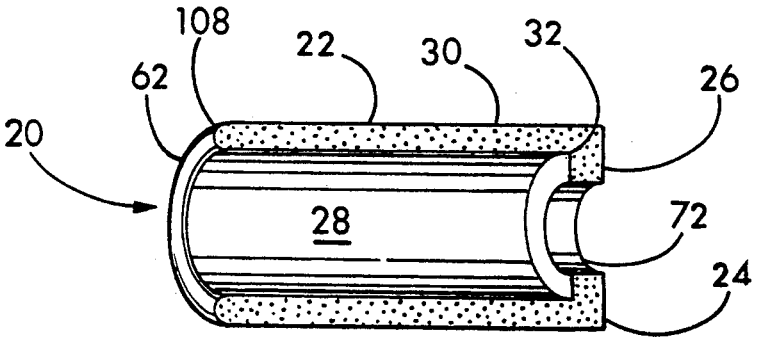
FIG. 1 is an perspective cross-sectional view of an activation magnet of this invention.
Figure 2:
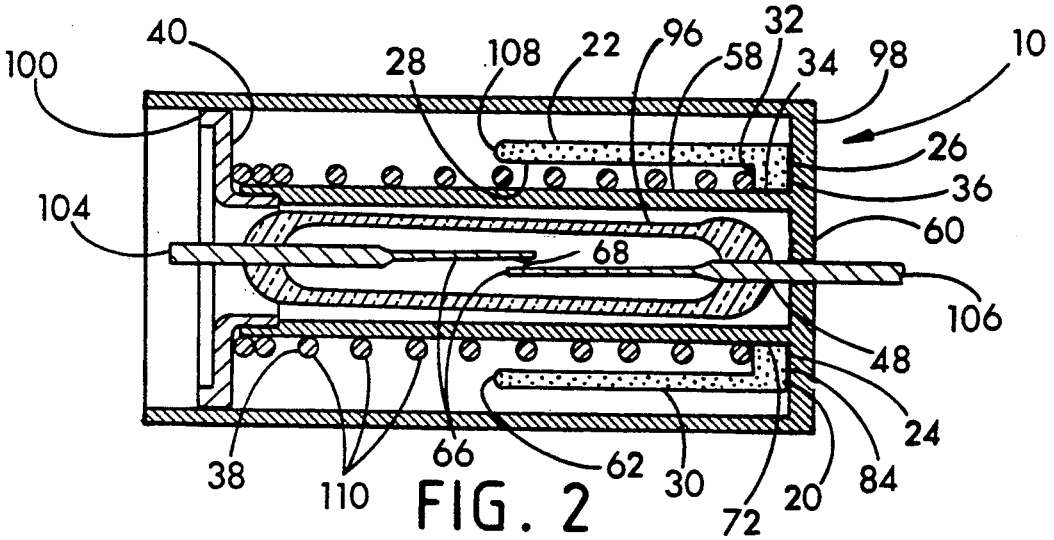
FIG. 2 is a schematic cross-sectional view of a shock sensor of this invention in a non-activated position.
Figure 3:
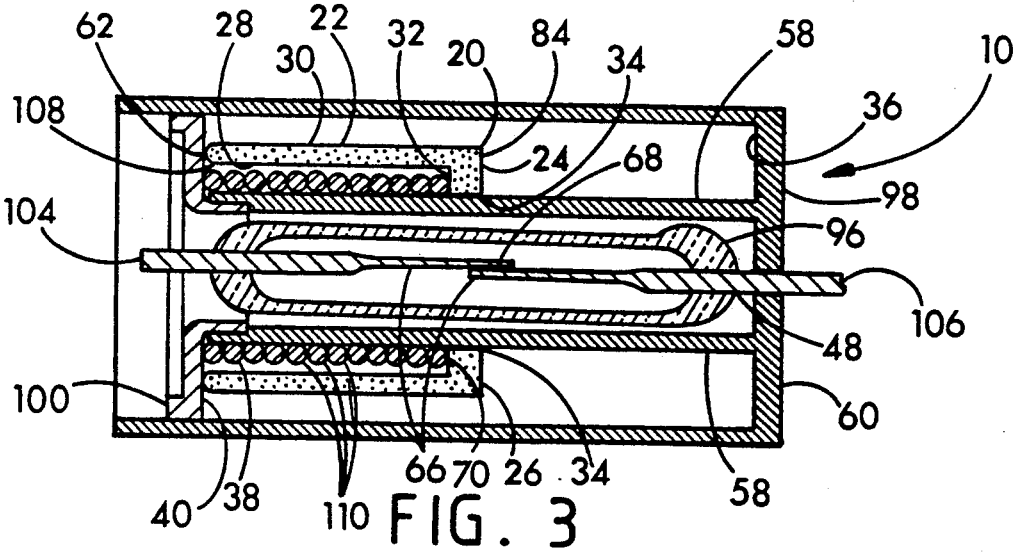
FIG. 3 is a schematic cross-sectional view of the shock sensor of FIG. 2 in the fully activated position.
Figure 4:
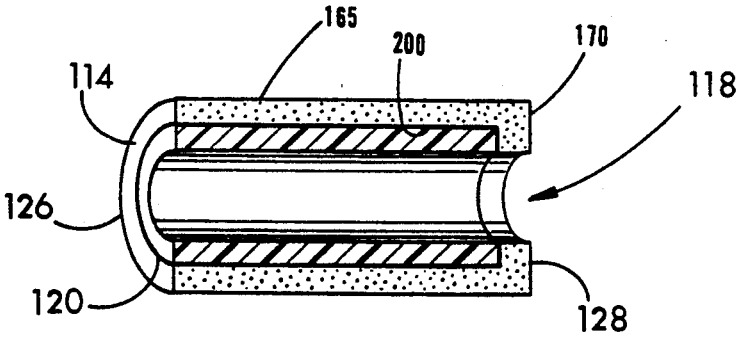
FIG. 4 is a perspective cross-sectional view of an alternative embodiment of the activation magnet of this invention.

Referring more particularly to FIGS. 1–16, wherein like numbers refer to similar parts, a shock sensor 10 is shown in FIGS. 2 and 3. The shock sensor 10 has a reed switch 48 mounted to a rigid housing 60 which is adapted to be positioned at an appropriate shock sensing location within a vehicle. An activation magnet 20 is mounted to the housing 60 to encircle the reed switch 48 and is held in a non-activating location during periods of non-activating acceleration by a biasing spring 38.

The reed switch 48 is mounted on the housing 60 to be responsive to the position of the activation magnet 20 such that the reed switch is activated when the magnet travels to a pre-selected activation position during movement of the magnet in response to an initial acceleration applied to the housing.

The activation magnet 20, shown in FIGS. 1, 2 and 3, has a cylindrical shell section 22 and a ring portion 24 which forms the first abutting end 26 of the magnet 20. The ring portion 24 is integral with the shell section 22 but has a smaller interior diameter which is adapted to fit around the sliding surface 58 of the housing 60.

The activation magnet 20 has an inner cylindrical surface 28 and an outer cylindrical surface 30. The inner surface 28 defines a cylindrical cavity. The ring portion has a radially extending surface 32 opposite the first abutting end 26 and extending between a cylindrical sliding surface 34 at the ring interior diameter and the inner surface 28.

The shock sensor 10 has a housing 60 within which is positioned the reed switch 48 which has two reeds 66 having contact areas 68. The reeds 66 are contained in a hermetically sealed glass housing 96 and are surrounded by the sliding surface 58 of the housing 60 which is closed on a first end 98 by a first abutment 36. The housing has a second end 100 with a second abutment 40. A helical spring 38 is disposed about the sliding surface 58 and biases the activation magnet 20, which functions as an acceleration-sensing mass, against the first abutment 36 by engaging the radially extending surface 32. The leads 104, 106 are connected to the circuit or device to be actuated.

To prevent the actuation magnet 20 from hanging up on the spring 38, the second abutting end 62 has a rounded profile 108 which helps to gather the coils 110 of the spring 38 as the actuation magnet 20 moves between the first abutment 36 and the second abutment 40 in response to a force produced by an acceleration.

Figure 12:
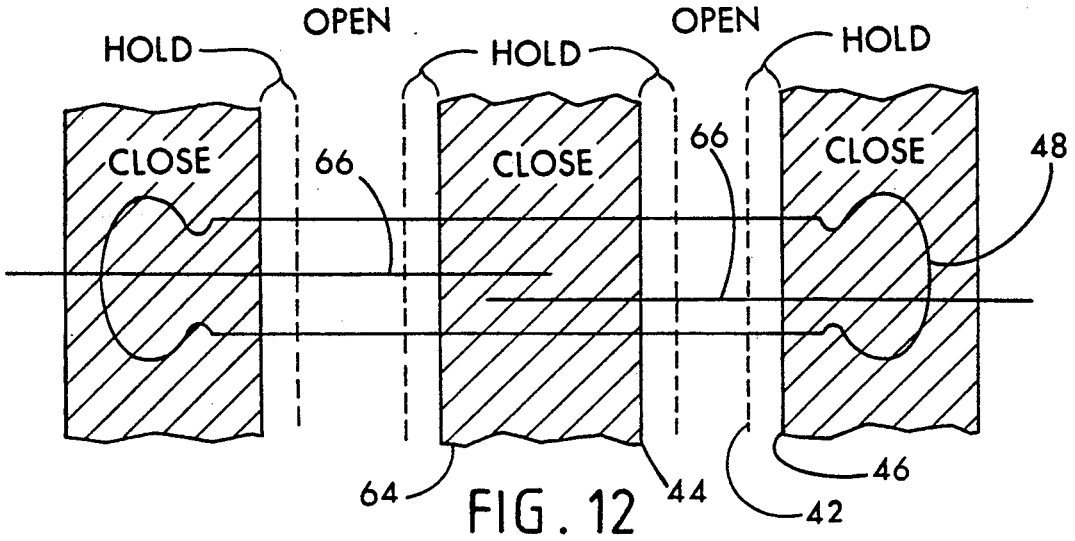
FIG. 12 is a schematic diagram of a reed switch showing how the hold areas are enlarged when the activation magnets of this invention are employed.

The activation magnet 20 forms a part of the shock sensor 10 and in the unactivated condition, shown in FIG. 2, the first abutting end 26 rests against the first abutment 36 and is biased against the first abutment by the spring 38 which extends between the second abutment 40 and the radially extending surface 32. The spring 38 in the unactivated condition extends partially within the magnet 20. When fully activated the spring 38 is contained entirely within the magnet 20. Referring to FIG. 12, the activation magnet, when it is engaged against the first abutment 36, is effectively in the open position indicated by 42 which lies between the hold regions 44 and 46.

Figure 10:
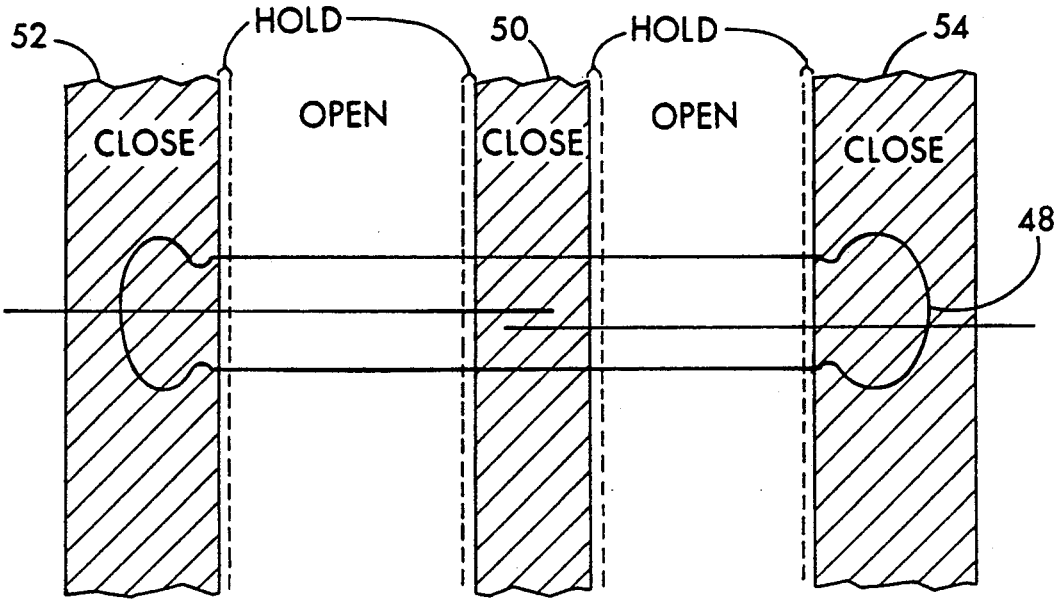
FIG. 10 is a schematic diagram of a prior art reed switch showing typical activation regions.
Figure 11:
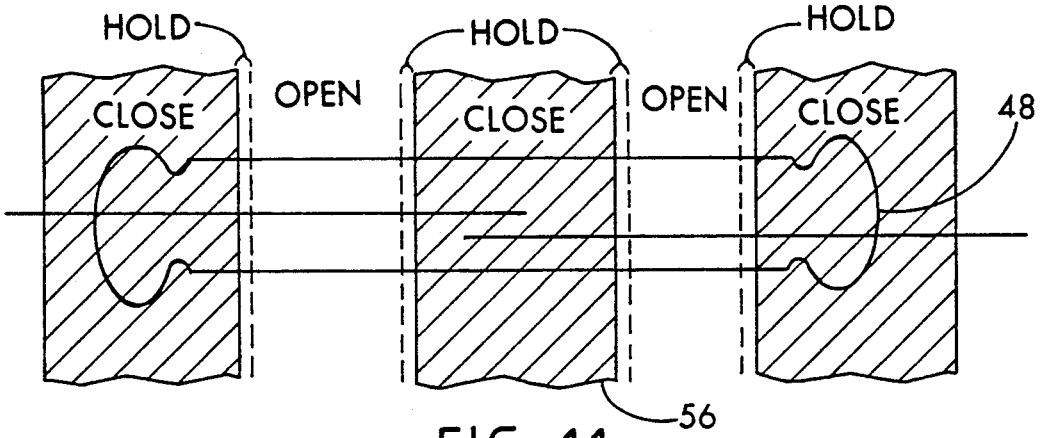
FIG. 11 is a schematic diagram of a reed switch showing how the activation regions are enlarged by a magnet of extended length such as employed in the shock sensor of this invention.

As illustrated in FIGS. 10, 11 and 12, the activation regions of a reed switch—indicated by the shaded regions labeled "close" in the figures—, are governed by the shape and length of the activation magnet. FIG. 10 shows an exemplary reed switch 48 showing typical activation regions which a typical axially mounted slidable cylindrical magnet would develop. There is a central region 50, which is the one normally employed in activating a typical reed switch, and two end activation regions 52 and 54.

The activation regions where a typical reed switch 48 will be activated may be increased in width as shown in FIG. 11 by employing a magnet of greater axial extent. The greater central activation region 56 allows a greater travel distance for the activation magnet 20 as it moves between a first abutment 36 and a second abutment 40 as shown in FIGS. 2 and 3. By receiving the spring 38 within the magnet 20, a greater length magnet may be employed with an appropriate biasing spring within a housing of a fixed size. In the shock sensor 10, this results in longer dwell time corresponding to the increased duration of the magnet within an activation region as it slides along the sliding surface 58 of the housing 60. The shock sensor 10 achieves an extended dwell time and a reduced physical package size by having the biasing spring 38 inside the cylindrical shell 22 of the magnet and abutting against the inner radial surface 32, rather than the second abutting end 62 of the magnet 20.

Due to the magnetic properties of the reed switch, the reeds, once brought into contact by the magnet passing into a close region, will remain in contact when the magnet leaves the close region at locations adjacent the close regions and designated hold regions.

As the activation magnet 20 moves from the open region 42, shown in FIG. 12 through the hold region 44 past a pre-determined activation position into the closed region 64, the reeds 66 become temporarily magnetized and attract each other, so closing the reed switch 48. The reed switch 48 remains closed as the activation magnet 20 moves through the closed region 64 to the second abutment 40 which stops the motion of the activation magnet 20 before it can leave the hold region 64. When the acceleration force is reduced or terminated, the activation magnet, which is functioning as an acceleration-detecting mass, is returned by the spring 38 to its original position abutting the first abutment 36. As the activation magnet 20 returns to the first abutment 36 it moves out of the closed region 64, however the switch remains closed until the magnet 20 has passed through the hold region 44.

For the purposes of this application, a property of reed switches, called hysteresis, is defined as the distance between the point where an applied magnetic field will cause a reed switch to close and the point where the same applied field will cause the switch to open as the applied field is moved from an open to a closed position and back to the open position. The geometry of the activation magnet 20, which has a concentration of magnetic material in the ring portion 24 in closer proximity to the reeds, results in a shock sensor 10 with hold regions of greater extent.

FIG. 12 illustrates the increased width of the hold region 44 caused by a magnet 20 having a region of increased magnetic strength adjacent to one end, such as caused by the ring portion 24 of the activation magnet 20. This increased width of the hold region 44 as illustrated in FIG. 12 and defined herein as increased hysteresis, provides two benefits to the shock sensor 10. First, it increases the total dwell time during which the shock sensor reed switch remains closed, because it increases the distance the activation magnet 20 must travel as the spring 38 returns the activation magnet 20 to the first abutment 36 before the reed switch opens.

Figure 16:
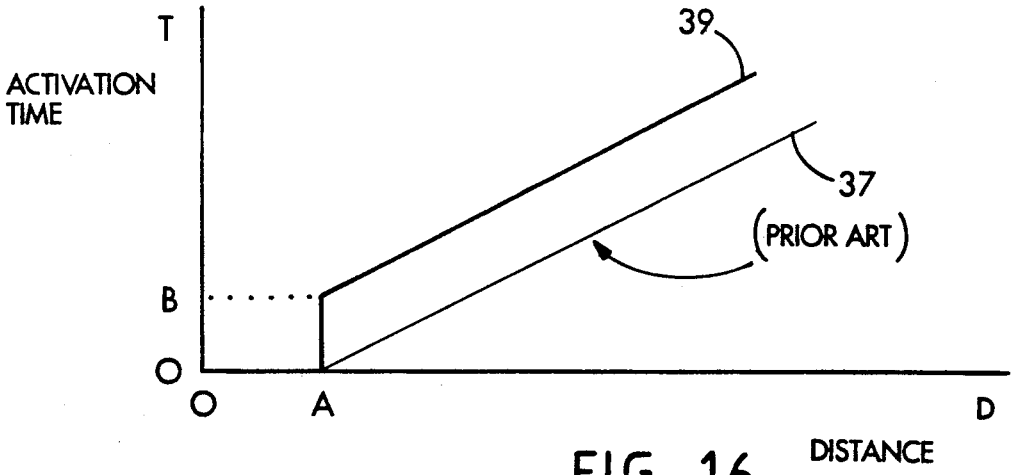
FIG. 16 is a graph illustrating the extended minimum dwell time achieved by the activation magnet of this invention.

The second advantage achieved by an activation magnet 20 or one creating a similar field shape, is to increase the minimum dwell time. This advantageous effect is further illustrated in FIG. 16, wherein the "T" axis represents time and the "D" axis represents axial movement of the activating magnet. The line 37 labeled "prior art" in FIG. 16 illustrates how, with a conventional shock sensor, a minimum crash just sufficient to move the activation magnet into the activation region, would result in a minimum activation time approaching zero. However, the Line 39 in FIG. 16 illustrates how a shock sensor 10 employing an activation magnet 20 having increased hysteresis will have a minimum activation time indicated by "B" on the "T" axis as the activation magnet 20 moves through the hold region 44.

When the shock sensor 10 responds to an intense and prolonged acceleration the magnet 20 will be driven against the second abutment 40 and the spring will remain compressed with the magnet firmly within the close region for as long as the acceleration continues. Such an extended acceleration event provides ample current through the switch to be effectively sensed.

Some acceleration events, however, are of extremely short duration, yet these events must also be sensed. In such a minimum event the magnet may only instantaneously enter the hold region and be immediately ejected by the biasing spring. A sensor with no hysteresis or hold region would detect no signal. Because of the extended hold region of the sensor, the magnet will hold the reeds closed throughout the time that the magnet is returning from its position within the close region even after a period of extremely short or nearly instantaneous acceleration. The magnet, even if it only just passes into the close region and instantly leaves the close region on its return journey to the open region, will —because of the sensor hysteresis—remain for a minimum dwell time within the hold region. Switches in general, and shock sensors in particular, which exhibit extended minimum dwell times are desirable because simpler, lower cost circuitry may be used in combination therewith to achieve the activation of an air bag or the like.

Extended minimum dwell also increases the reliability of detecting a positive actuation of a switch or shock sensor. By increasing the duration of the activation signal it may readily be distinguished from a spurious signal caused by noise or electromagnetic interference in the activation circuit. Noise or electromagnetically induced voltages in a circuit will normally have a relatively high frequency in the time domain and the signal from an extended minimum dwell switch or shock sensor results in a signal of high strength and low frequency which may readily be distinguished by the electronic circuitry used in conjunction with the switch to detect its activation.

A sensor having increased hysteresis and minimum dwell time may be advantageously used wherever it is desirable to have a single signal or current pulse. Often, when a mechanical switch is actuated, it will not make a discrete transition from the "off" to "on" but instead, will oscillate, turning on and off a number of times before finally remaining on. This tendency of mechanical switches to oscillate when first activated or deactivated, is referred to as "switch bounce."

Reed switches have mechanical bounce caused by the reeds bouncing against each other when the reed switch is activated. However, this type of bounce can be eliminated by using a mercury-wetted reed switch, where a film of mercury on the reeds bridges the gap between the reeds as they momentarily bounce apart. Bounce in a reed switch could also be caused by oscillation of the activation magnet moving in and out of the activation region. A reed switch employing the activation magnet of this invention which has increased hysteresis, and therefore extended minimum dwell, will prevent the reed switch from opening due to small oscillations of the activation magnet in and out of the closure region.

The shock sensor 10, shown in FIGS. 2 and 3, accomplishes a major goal of the crash sensor industry of extending the dwell or closure duration of the current carrying contacts 68, which are the contact-forming portions of the reed 66, as simply as possible. Known methods of simply allowing a greater range of motion of the sensing mass/activation magnet while the contacts are being held closed, provides limited improvement. This type of conventional coaxial reed switch/magnetic mass system may lengthen the main closure regions, but will not appreciably increase magnetic hysteresis, which is the key contributor toward closure duration in minimum crash conditions. Without contact switching hysteresis, minimum dwell or closure duration, as illustrated in FIG. 16, can be zero.

The shock sensor 10 accomplishes another major goal of the crash sensor industry, that of reduced package size. As shown in FIGS. 2 and 3, the length of the activation magnet may be lengthened without requiring the housing 60 to be lengthened to accommodate the compressed height 70 of the spring 38.

The activation magnet/acceleration-sensing mass 20 alters the conventional toroidal magnetic field to provide significantly increased hysteresis and provides a lengthened main closure region, shown in FIGS. 11 and 12, without affecting package size. The magnet 20 is a toroidal magnet, lengthened to optimize the main closure region 64 with the first abutting end 26 that lags in activation brought to a smaller diameter 72 for a brief distance.

The ring portion 24 with (see FIG. 13), or without (illustrated in FIG. 14), a cylindrical section provides a concentrated flux region which will boost the magnetic hysteresis in relation inverse to ring length. By way of illustrative example, an activation magnet with no ring (or the ring extending full length) would have a hysteresis of 6 milliseconds. An activation magnet having a ring axial length of 1 mm. would have a hysteresis of 8 milliseconds. An activation magnet having a ring axial length of 0.5 mm. would have a hysteresis of 10 milliseconds.

An exemplary shock sensor could be built as illustrated in FIGS. 2 and 3, where the activation magnet 20 would move 0.060 from the rest position adjacent to the first abutment 36 inches towards the second abutment 40 due to a crash-induced acceleration. The 0.060 inches movement of the activation magnet 20 would activate the reed switch 94, and the reed switch 94 would remain activated through 0.350 inches of travel until the activation magnet 20 stops in contact with the second abutment 40. This movement of 0.350 inches takes place within the central activation region 64 as shown in FIG. 12. The switch 94 would remain activated during the activation magnet's return from the second abutment 40 to the end of the activation region 64, 0.350 inches, and in addition, would remain activated for 0.030 inches as the activation magnet 20 moves through the hold region 44. This performance is in contrast to a conventional shock sensor of similar package size, which would have an activated travel distance of 0.150 inches and a return activation distance of 0.150 inches, plus a hysteresis travel distance of 0.010 inches.

Figure 5:
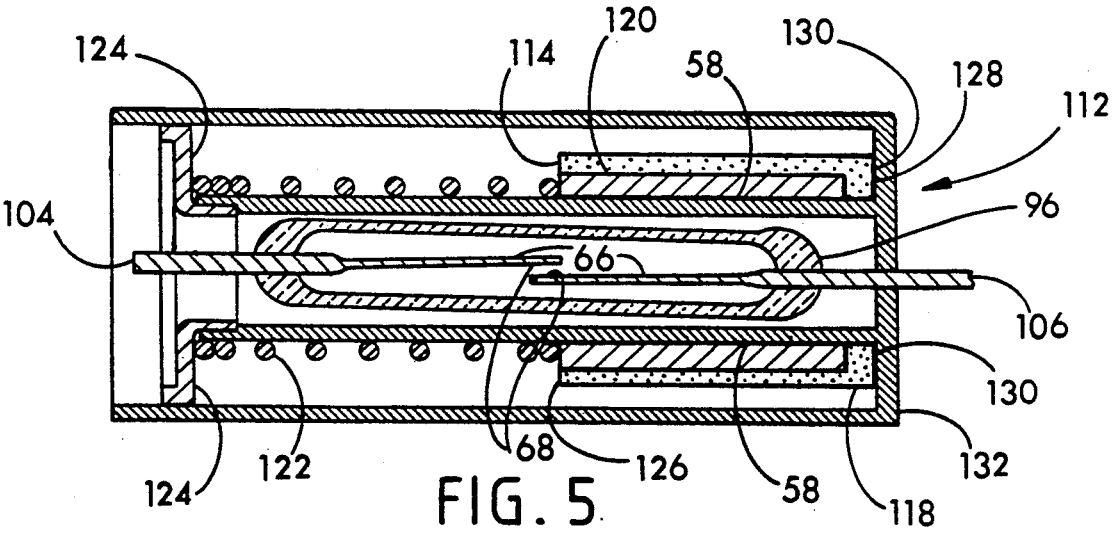
FIG. 5 is a schematic cross-sectional view of an alternative embodiment shock sensor of this invention shown in the non-activated position.
Figure 6:
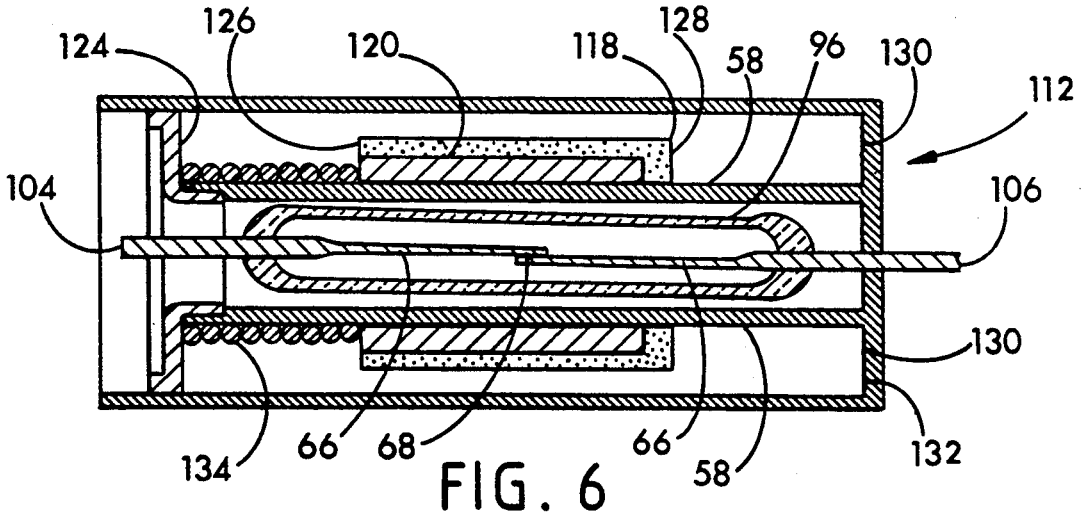
FIG. 6 is a schematic cross-sectional view of the shock sensor of FIG. 5 shown in the activated position.
Figure 7:
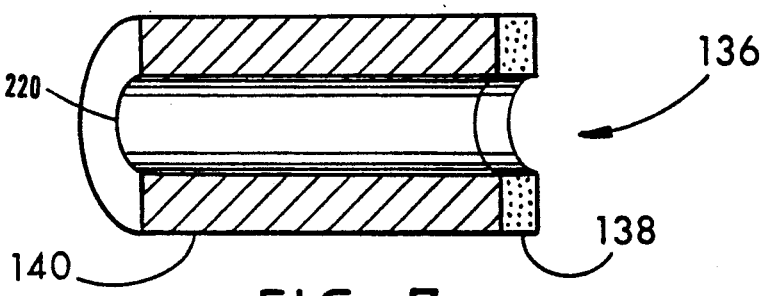
FIG. 7 is a perspective cross-sectional view of another embodiment of the activation magnet of this invention.

In situations where the shock sensor may be subject to significant accelerations not aligned with the axis of the shock sensor, it may be desirable to employ an alternative shock sensor 112, best shown in FIGS. 5 and 6. The shock sensor 112 has an activation magnet 118 with a cylindrical shell 165 and an integral ring portion 170 similar to the activation magnet 20 shown in FIG. 1. To avoid influencing spring forces during impact due to pressure from the leading edge 114 of the activation magnet 20 of FIG. 1 on spring 36, the interior cylindrical cavity 200 of the actuation magnet 118 may be filled with a non-magnetic component 120, so that the spring 122 lies wholly outside the magnet 118. The spring 122 then will be biased between a second abutment 124 and the second end 126 of the activation magnet/acceleration-sensing mass 118. In the unactivated position, the biasing spring 122 will hold the first end 128, which is the end that lags in activation, against a first abutment 130. The housing 132 of the shock sensor 112 will be longer than the housing 60 of the shock sensor 10 seen in FIGS. 2 and 3 because of the height of the compressed spring 134 between the second abutment 124 and the second end 126 of the actuation magnet 118.

Figure 8:
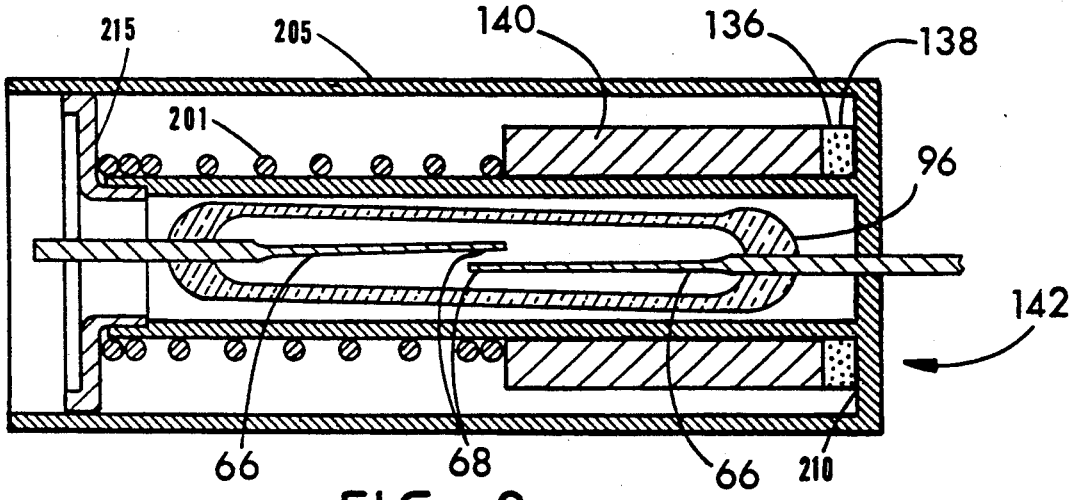
FIG. 8 is a schematic cross-sectional view of the shock sensor of FIG. 8 shown in the non-activated position.
Figure 9:
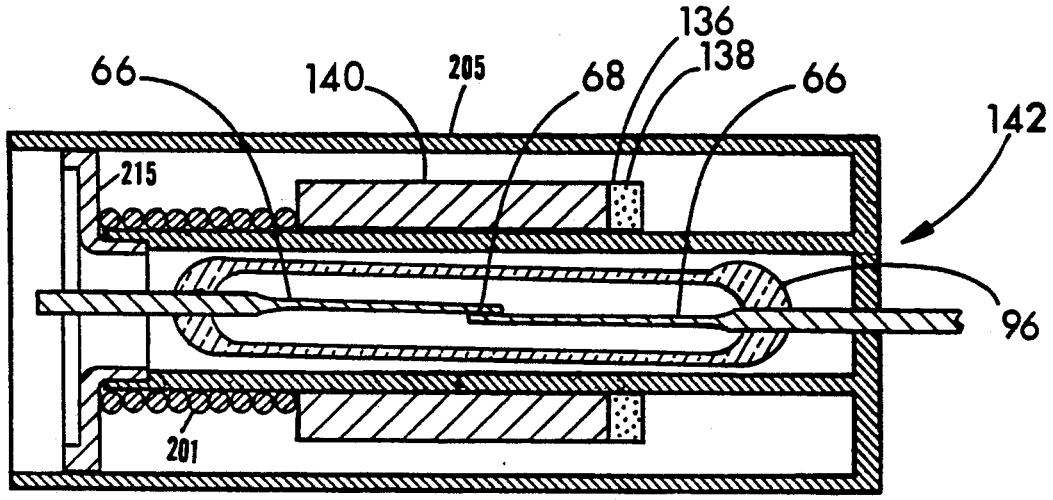
FIG. 9 is a schematic cross-sectional view of another embodiment of the shock sensor of this invention shown in the activated position.

Another shock sensor 142 embodying increased hysteresis is shown in FIGS. 8 and 9. The shock sensor 142 has an activation magnet 136 biased by a spring 201 against the first abutment 210 of the housing 205. Under acceleration of a predetermined amount, the magnet 136 will travel past an activation position to engage against the second abutment 215. The activation magnet 136 shown in FIG. 7 has an annular ring 138 of magnetic material of minimal axial extent attached to a non-magnetic cylindrical carriage 140. The magnet 136 has portions defining an interior cylindrical cavity 220. The use of the activation magnet 136 results in the shock sensor 142 exhibiting extended minimum dwell and increased hysteresis. The axial length of the ring 138 is less than the axial length of the carriage 140. The shock sensor 142 is illustrative of a switch with minimum packaging size, but still exhibiting an increased minimum dwell time.

Figure 13:
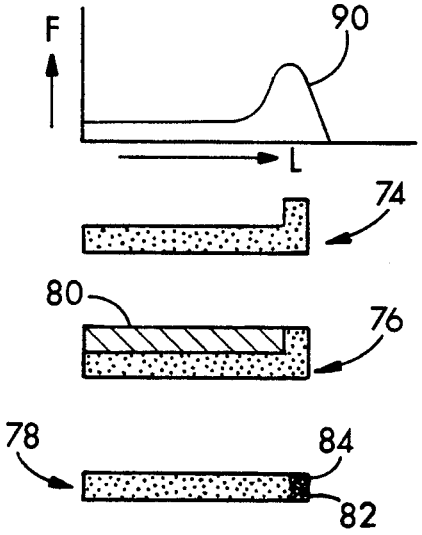
FIG. 13 is a diagram illustrating different embodiments of the activation magnet of this invention which generate a similar shaped magnetic field.

FIG. 13 illustrates how magnets of different physical configuration may have similar magnetic field shapes which cause increased hysteresis. The graph shown in FIG. 13 has an "F" axis representing magnetic field strength, and an "L" axis representing distance along the actuation magnets 74, 76, 78, which are shown in FIG. 13 as the lower half of the cross-section of the torroidal magnets 74, 76 and 78 illustrated. The first magnet 74 is one having a shape similar to activation magnet 20. The second magnet 76 is similar to activation magnet 118 with a non-magnetic insert 80 similar to Insert 120. The third magnet 78 has a constant cross-sectional area, but has a region 82 at the activation lagging end 84, which produces a field of greater magnetic strength. A magnet 78 shown in FIG. 13 may be created with a properly designed tool for magnetization.

Figure 14:
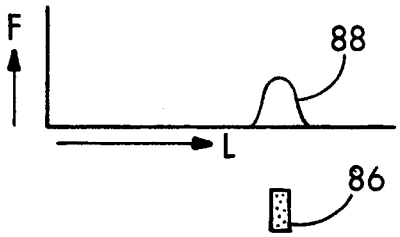
FIG. 14 illustrates the field shape of a narrow ring activation magnet as employed in this invention.

FIG. 14 shows a graph having an "F" axis indicating magnetic field strength and an "L" axis indicating distance along a torroidal magnet 86 shown in FIG. 14 as one-half of the cross-section, the magnetic field has a profile 88 similar to the portion 90 of the magnetic profile illustrated in FIG. 13.

Figure 15:
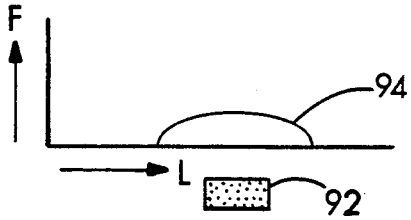
FIG. 15 is an illustration of prior art magnetic field shape.

FIG. 15 illustrates how a conventional torroidal magnet 92 has a field profile 94 which is dissimilar from profile 88 illustrated in FIG. 14 and not suitable for causing increased hysteresis.

Although the examples described and illustrated are for a shock sensor adapted for use in automobile applications, it should be understood that the principles of extended dwell and increased hysteresis may be used as sensors in other applications requiring similar sensor properties.

Although FIG. 16 is illustrative of the increased minimum actuation time of the switches of this invention, prior art switches may have some non-zero minimum actuation time. Further, although the relationship between activation distance and activation time is shown to be linear or a step function, in practice the relationship between activation time and distance traveled for the activation magnet may be non-linear.

An alternative activation magnet 78 is shown in FIG. 13. The magnet 78 has a region 82 of increased magnetization and may be employed in a shock sensor similar to the ones illustrated in FIGS. 2–3, 5–6, 8 and 9.

Magnets for use in activating reed switches and achieving the advantages of increased hysteresis may be fabricated from any magnetic material. They will preferably be manufactured from a polymeric host material having magnetic particles suspended therein. The magnetic particles support a magnetic field and therefore allow the use of an easily formed material such as plastic containing a filler material of magnetic particles to cost-effectively manufacture activation magnets which achieve the benefits of increased hysteresis.

It should be understood that where a spring is shown employed for biasing the activation magnets in an off position, the biasing means could be provided by a pneumatic piston, a superimposed magnetic field, an elastomeric member, a spring or a torsion bar.

It is understood that the invention is not confined to the particular construction and arrangement of parts herein illustrated and described, but embraces such modified forms thereof as come within the scope of the following claims.

I claim:

1. A shock sensor comprising:

a) a housing having a first abutment and a second abutment spaced a fixed distance from the first abutment;

b) an activation magnet slidably mounted on the housing and having a first portion adapted to engage against the first abutment and a second portion adapted to engage against the second abutment, wherein the first portion has a greater magnetic flux than the second portion;

c) a reed switch mounted to the housing to be responsive to the position of the activation magnet and coaxial with the magnet such hat the reed switch is activated when the magnet travels to a pre-selected activation position during movement of the magnet in response to an initial acceleration force applied to the sensor;

d) a means for biasing the magnet such that the first portion engages against the first abutment and the reed switch remains unactivated until the housing is subjected to a pre-selected level of acceleration, such that a pre-selected level of acceleration will cause the magnet to slide on the housing past the pre-selected activation position to activate the reed switch.

2. The shock sensor of claim 1 wherein the activation magnet second portion comprises a cylindrical shell with portions defining an interior cylindrical cavity of a first diameter and the first portion comprises a cylindrical ring which is fixed to the shell and has portions defining a second interior cavity of a diameter which is less than the first diameter.

3. The shock sensor of claim 2 further comprising a nonmagnetic cylindrical component located within the shell interior cavity and having portions defining an interior cylindrical cavity coaxial with the second interior cavity and of substantially the same diameter as the second interior cavity.

4. The shock sensor of claim 1 wherein the activation magnet first portion comprises an annular ring of magnetic material, and the activation magnet second portion comprises a cylinder of nonmagnetic material.

5. The shock sensor of claim 1 wherein the activation magnet is a cylinder of constant exterior diameter and having portions defining an interior cylindrical cavity of constant interior diameter and the first portion comprises material of greater magnetic intensity than the material of the second portion.

6. A shock sensor comprising:

a) a housing;

b) an activation magnet slidably mounted to the housing, the magnet having a cylindrical shell portion with portions defining an interior cylindrical cavity of a first diameter and the magnet having a cylindrical ring portion integral with the shell portion and having portions defining a second interior cylindrical cavity coaxial with the shell interior cylindrical cavity and of a diameter which is less than the first diameter;

c) a reed switch mounted on the housing to be responsive to the position of the activation magnet and coaxial with the magnet such that the reed switch is activated when the magnet travels to a pre-selected activation position during movement of the magnet in response to an initial acceleration force applied to the housing; and d) a means for biasing the magnet in an unactivated position until the housing is subjected to a pre-selected level of acceleration, such that a pre-selected level of acceleration will cause the magnet to slide on the housing past the pre-selected activation position to activate the reed switch.

7. The shock sensor of claim 6 further comprising a nonmagnetic cylindrical component located within the shell interior cavity and having portions defining an interior cylindrical cavity coaxial with the second interior cavity and of substantially the same diameter as the second interior cavity.

8. The shock sensor of claim 6 further comprising:

a) a first abutment located on the housing and a second abutment located on the housing and spaced a fixed distance from the first abutment; and b) portions of the cylindrical shell opposite the ring portion of the magnet which define a rounded profile, and wherein the biasing means comprises a spring extending between the second abutment and the ring portion, the rounded profile adapted to direct the spring into the shell interior cavity as the magnet moves from a position adjacent the first abutment to a position adjacent the second abutment.

9. The shock sensor of claim 8 wherein the magnet shell interior cavity is dimensioned to enclose the spring when the magnet engages against the second abutment.

10. The shock sensor of claim 6 wherein the housing has a first abutment and a second abutment spaced a fixed distance from the first abutment, and wherein the biasing means comprises a spring extending between the second abutment and the ring portion of the magnet, wherein the spring biases the magnet against the first abutment when the housing is not subjected to a pre-selected level of acceleration, and wherein the spring extends within the shell portion interior cylindrical cavity.

11. The shock sensor of claim 6 wherein the activation magnetic comprises a polymeric host material having magnetic particles suspended therein.

12. A shock sensor comprising:

a) a housing;

b) a cylindrical nonmagnetic carriage having an axial length and having portions defining a cylindrical interior cavity;

c) an annular activation magnet having an axial length less than the carriage axial length and the activation magnet is fixed to the carriage and has portions defining an interior opening which is coaxial with the carriage interior cavity;

d) a reed switch mounted on the housing to be responsive to the position of the activation magnet and coaxial with the magnet such that the reed switch is activated when the magnet travels to a pre-selected activation position during movement of the carriage in response to an initial acceleration force applied to the housing; and e) a means for biasing the magnet such that the magnet in a position which does not activate the reed switch when the acceleration force applied to the housing is less than a pre-selected amount.

13. The shock sensor of claim 12 wherein the housing has a first abutment and a second abutment spaced a fixed distance from the first abutment, and wherein the biasing means comprises a spring extending between the first abutment and the activation magnet, and wherein the spring biases the magnet against the second abutment when the sensor housing is not subjected to a pre-selected level of acceleration, and wherein the spring extends within the cylindrical interior cavity of the nonmagnetic carriage.

14. The shock sensor of claim 12 wherein the activation magnet comprises a polymeric host material having magnetic particles suspended therein.

15. A shock sensor comprising:

a) a housing;

a cylindrical integral activation magnet slidably mounted to the housing, the magnet having a first portion having a magnetic intensity of a certain level and a second portion integrally formed with the first portion and having a greater magnetic intensity;

c) a reed switch mounted on the housing to be responsive to the position of the activation magnet and coaxial with the magnet such hat the reed switch is activated when the magnet travels to a pre-selected activation position during movement of the carriage in response to an initial acceleration force applied to the housing; and d) a means for biasing the magnet in an unactivated position until the housing is subjected to a pre-selected level of acceleration such that a pre-selected level of acceleration will cause the magnet to slide on the housing past the pre-selected activation position to activate the reed switch.

16. The shock sensor of claim 15 wherein the activation magnet comprises a polymeric host material having magnetic particles suspended therein.

* * * * *

UNITED STATES PATENT AND TRADEMARK OFFICE

CERTIFICATE OF CORRECTION

PATENT NO. : 5,212,357

DATED : May 18, 1993

INVENTOR(S) : Daniel R. Reneau

It is certified that error appears in the above-indentified patent and that said Letters Patent is hereby corrected as shown below:

In Column 9, line 49, delete "hat" and substitute --that-- therefor;

In Column 11, line 25, delete "magnet such that" and substitute --carriage to locate-- therefor;

In Column 12, line 19, delete "hat" and substitute --that-- therefor.

Signed and Sealed this

Twentieth Day of June, 1995

Bruce Lehman

*Attest:*

BRUCE LEHMAN

*Attesting Officer*

*Commissioner of Patents and Trademarks*